US008539940B2

(12) United States Patent
Vosika

(10) Patent No.: US 8,539,940 B2
(45) Date of Patent: Sep. 24, 2013

(54) JEWELRY BENCH DUST SHIELD

(76) Inventor: Lee Brian Vosika, Vancouver, WA (US)

( * ) Notice: Subject to any disclaimer, the term of this patent is extended or adjusted under 35 U.S.C. 154(b) by 605 days.

(21) Appl. No.: 12/578,495

(22) Filed: Oct. 13, 2009

(65) Prior Publication Data

US 2010/0112918 A1 May 6, 2010

Related U.S. Application Data

(60) Provisional application No. 61/111,682, filed on Nov. 5, 2008.

(51) Int. Cl.
*B28D 5/02* (2006.01)
*B24B 55/06* (2006.01)

(52) U.S. Cl.
USPC ..... 125/30.01; 451/456

(58) Field of Classification Search
USPC ..... 451/451, 452, 453, 454, 455, 456; 125/30.01
See application file for complete search history.

(56) References Cited

U.S. PATENT DOCUMENTS

| | | | | |
|---|---|---|---|---|
| 2,011,108 | A * | 8/1935 | Lehmann | 451/451 |
| 2,201,244 | A * | 5/1940 | Root | 425/152 |
| 2,399,677 | A * | 5/1946 | Hood et al. | 30/124 |
| 3,860,085 | A * | 1/1975 | Gilbert et al. | 181/205 |
| 4,794,740 | A * | 1/1989 | Keith et al. | 451/456 |
| 4,799,336 | A * | 1/1989 | Yang | 451/241 |
| 6,699,114 | B1 * | 3/2004 | Campbell et al. | 451/451 |

* cited by examiner

*Primary Examiner* — Robert Rose
(74) *Attorney, Agent, or Firm* — Rylander & Associates, PC; Kurt M. Rylander; Philip R. M. Hunt

(57) ABSTRACT

A jewelry bench dust shield including a base attachable to a jewelry bench, an arm pivotally attached to said base, and a dust shield attached to said arm. A jewelry bench dust shield including a vacuum triggering pivoting arm, a trigger holding arm pivot base attachable to a jewelry bench, and a face plate connected to said arm. A jewelry bench dust shield including a base attachable to a jewelry bench, a vacuum trigger connected to said base having a wire connectable to a vacuum, an arm pivotally attached to said base, said arm having an extension portion which depresses said trigger when arm is lowered, and which releases said trigger when arm is raised, and a face plate connected to said arm.

10 Claims, 3 Drawing Sheets

JEWELRY BENCH DUST SHIELD

CROSS-REFERENCE TO RELATED APPLICATIONS

The present application claims priority to co-pending U.S. Provisional Application Ser. No. 61/111,682, filed 5 Nov. 2008, which is hereby incorporated by reference into the present application.

FIELD OF THE INVENTION

The present invention relates to jewelry bench dust shields.

BACKGROUND

Jewelers typically work at benches where stones are ground and cut. Dust is a bothersome byproduct of this profession. It gets in the eyes, hair, and orifices of the jewelers. Moreover, the dust generated obscures the jewelers vision There is a need for a dust shield that protects a jewelers face from the dust generated from cutting stones and which helps reduce the vision obscurity created by such dust.

SUMMARY AND ADVANTAGES

A jewelry bench dust shield including a base attachable to a jewelry bench, an arm pivotally attached to said base, and a dust shield attached to said arm. A jewelry bench dust shield including a vacuum triggering pivoting arm, a trigger holding arm pivot base attachable to a jewelry bench, and a face plate connected to said arm. A jewelry bench dust shield including a base attachable to a jewelry bench, a vacuum trigger connected to said base having a wire connectable to a vacuum, an arm pivotally attached to said base, said arm having an extension portion which depresses said trigger when arm is lowered, and which releases said trigger when arm is raised, and a face plate connected to said arm.

The jewelry bench dust shield of the present invention presents numerous advantages, including: (1) stops stone and metal ground dust and/or polished dust from reaching the jeweler's orifices, hair and face; (2) automatically triggers a vacuum when the shield face plate is lowered and automatically ceases the triggering action when the shield face plate is raised; and (3) can easily be attached to existing jewelry benches; improves jeweler vision during grinding.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS USED IN DRAWINGS

Figure 1:
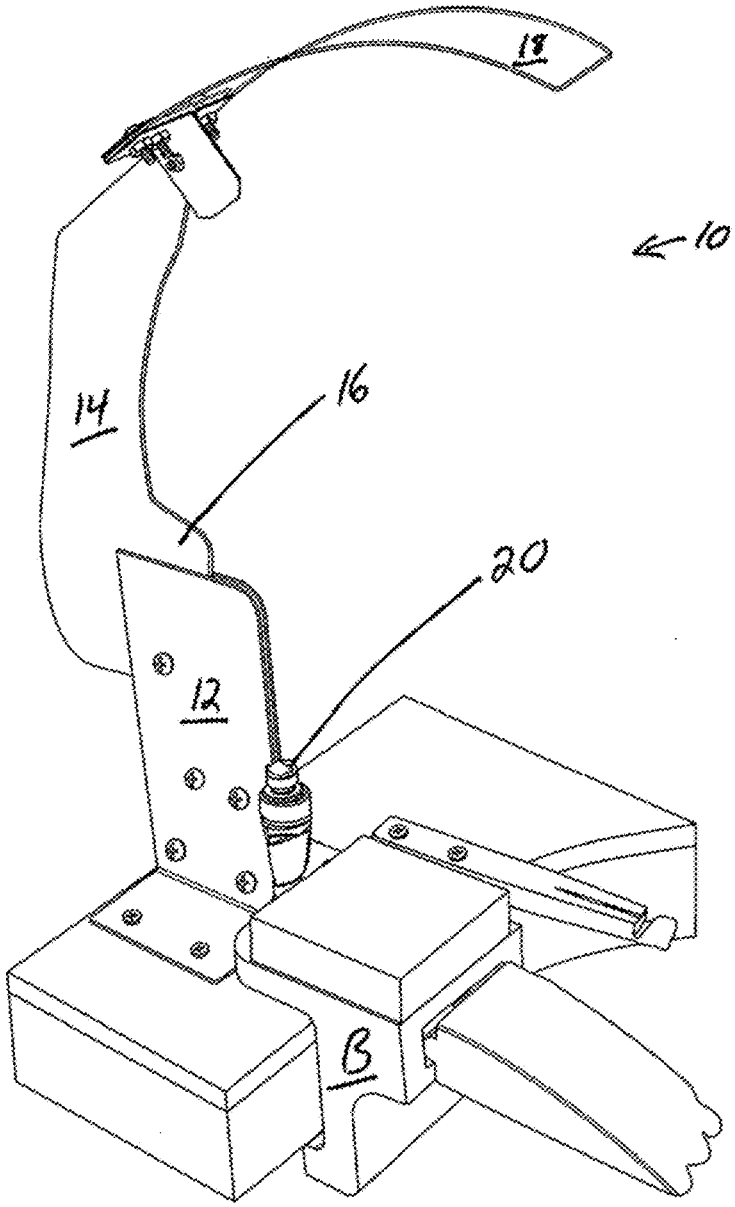
FIG. 1 shows an embodiment of Applicant's jewelry bench dust shield attached to a jeweler's bench.

Turning now descriptively to the drawings, in which similar reference characters denote similar elements throughout the several views, the figures illustrate the jewelry bench dust shield of the present invention. With regard to the reference numerals used, the following numbering is used throughout the various drawing figures:

10 Jewelry bench dust shield
12 Base
14 Arm
16 Arm extending portion
18 Face plate
20 Trigger
22 Vacuum line
B Jeweler's bench
BA Jeweler's bench anvil
BP Jeweler's bench pin

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

A jewelry bench dust shield including a base attachable to a jewelry bench, an arm pivotally attached to said base, and a dust shield attached to said arm. A jewelry bench dust shield including a vacuum triggering pivoting arm, a trigger holding arm pivot base attachable to a jewelry bench, and a face plate connected to said arm. A jewelry bench dust shield including a base attachable to a jewelry bench, a vacuum trigger connected to said base having a write connectable to a vacuum, an arm pivotally attached to said base, said arm having an extension portion which depresses said trigger when arm is lowered, and which releases said trigger when arm is raised, and a face plate connected to said arm.

Figure 2:
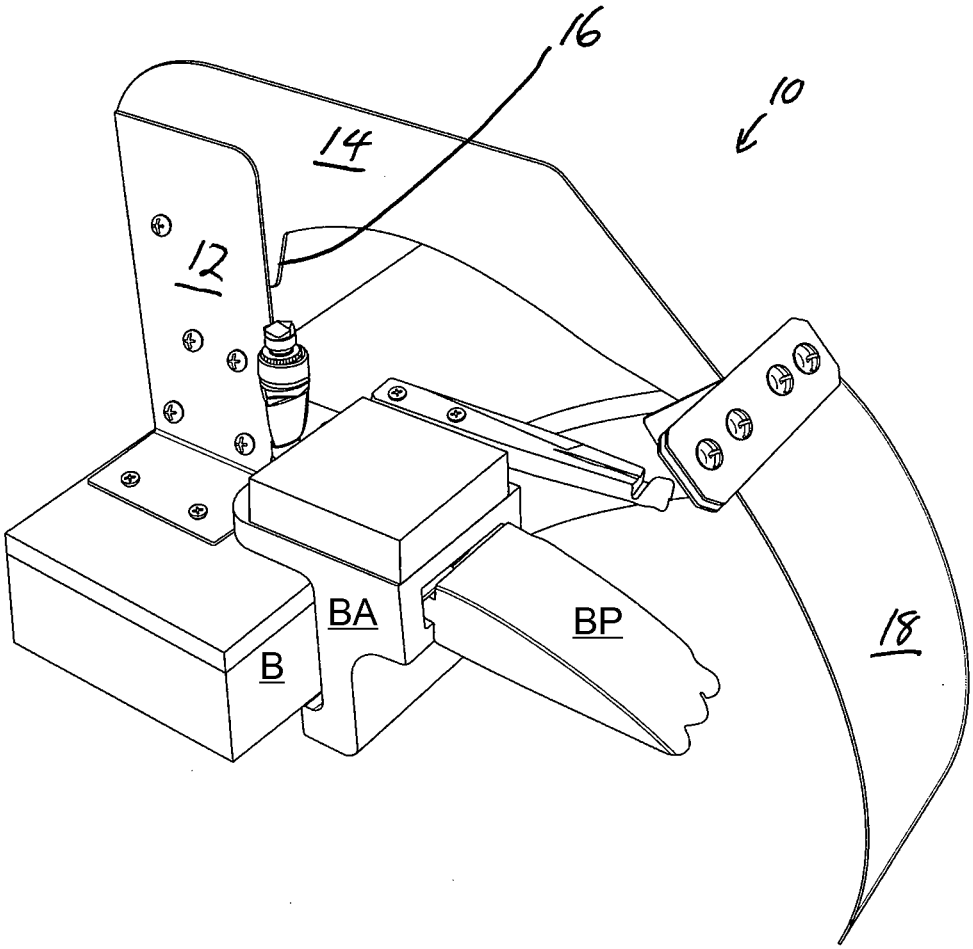
FIG. 2 shows another view of the embodiment of FIG. 1.
Figure 3:
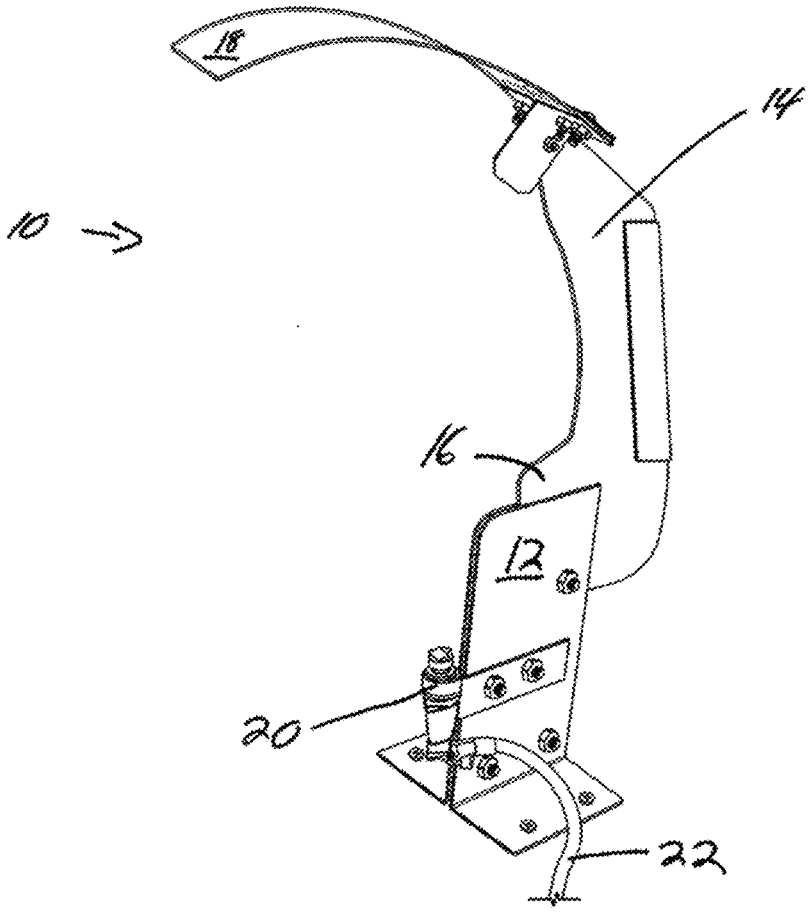
FIG. 3 shows another view of the embodiment of FIG. 1 unattached from a jeweler's bench

As shown in FIGS. 1-3, a jewelry bench dust shield 10 is provided and includes a base 12, an arm 14, and a face plate 18. A jewelry bench dust shield 10 can further include a vacuum trigger 20 connectable to a vacuum (not shown) by a wire (not shown) for automatically triggering a dust vacuum when the arm 14 and face plate 18 are lowered, and stopping the dust vacuum when the am 14 and face plate 18 are raised.

Base 12 attaches to a jeweler's bench B, immediately behind jeweler's bench anvil BA and jeweler's bench pin, BP, as shown in FIGS. 1 and 2.

Arm 14 pivotally connects to the base 12 to be raised and lowered. Arm 14 is preferably not loosely connected, but connected with friction opposition so that arm 14 stays in the position at which the user leaves it.

Face plate 18 connects to the arm 14 and is a transparent shield, preferably curved, of sufficient width and length to provide a shield to the users face, preferably 4 inches by 10 inches.

Vacuum trigger 20 is attached to the base 12 below the arm 14. Arm 14 preferably has an extending portion 16 where it connects to the base 12 such that when the arm 14 is lowered, the extending portion 16 depresses the trigger 20. Electric line 22 runs from the trigger 20 to the vacuum (not shown).

In operation in one embodiment, the jeweler at the dust bench B, having previously attached the jewelry bench dust shield 10 to the bench B as shone in FIGS. 1 and 2, lowers the arm 14 and face plate 18 upon preparing to grind and polish metals and stones. This depresses the trigger 20, starting the vacuum. The dust generated by the grinding or polishing is stopped from obscuring the jeweler's face and from reaching the jewelers' hair, face, eyes, and orifices by the face plate 18 and also by the action of the trigger 20 activated vacuum which reduces the amount of dust being generated between the object being ground or polished and the face plate 18. When the jeweler is done grinding or polishing, the jeweler raises the arm 14 and face plate 18, which ceases the depression of the vacuum trigger 20 stopping the vacuum.

In operation in another embodiment, the jeweler at the dust bench B, having previously attached the jewelry bench dust shield 10 to the bench B as shone in FIGS. 1 and 2, lowers the arm 14 and face plate 18 upon preparing to grind and polish metals and stones. The dust generated by the grinding or polishing is stopped from obscuring the jeweler's face and from reaching the jewelers' hair, face, eyes, and orifices by the face plate 18. When the jeweler is done grinding or polishing, the jeweler raises the arm 14 and face plate 18.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A jewelry bench dust shield, comprising:

a base attachable to a jewelry bench;

a vacuum trigger connected to said base having a wire connectable to a vacuum;

an arm pivotally attached to said base, said arm having an extension portion which depresses said trigger when arm is lowered, and which releases said trigger when arm is raised, wherein the arm comprises a thin sheet with a thin top, a thin bottom and wide sides; and a face plate connected to said arm.

2. A jewelry bench dust shield, comprising:

a base attachable to a jewelry bench;

a vacuum line attached to the base;

a vacuum trigger connected to said base having a wire connectable to a vacuum;

an arm pivotally attached to said base, said arm having an extension portion which depresses said trigger which starts the vacuum when arm is lowered, and which releases said trigger and stops the vacuum when arm is raised, wherein the arm comprises a thin sheet with a thin top, a thin bottom and wide sides; and a face plate connected to said arm.

3. The jewelry bench dust shield of claim 1, wherein the face plate is curved.

4. The jewelry bench dust shield of claim 1, wherein the arm pivotally attached to the base is configured to move in a plane defined by the thin top and thin bottom.

5. The jewelry bench dust shield of claim 4, wherein the thin bottom of the arm has a generally upwardly concave shape.

6. The jewelry bench dust shield of claim 5, wherein the generally concave shape of the thin bottom of the arm is configured such that there is sufficient working space for a jeweler's hands behind the face plate, below the arm and above a typical jeweler's bench anvil and jeweler's bench pin when the base is attached to a jewelers' bench immediately behind the jeweler's bench anvil and jeweler's bench pin.

7. The jewelry bench dust shield of claim 1, wherein the face plate is curved.

8. The jewelry bench dust shield of claim 1, wherein the arm pivotally attached to the base is configured to move in a plane defined by the thin top and thin bottom.

9. The jewelry bench dust shield of claim 8, wherein the thin bottom of the arm has a generally upwardly concave shape.

10. The jewelry bench dust shield of claim 9, wherein the generally concave shape of the thin bottom of the arm is configured such that there is sufficient working space for a jeweler's hands behind the face plate, below the arm and above a typical jeweler's bench anvil and jeweler's bench pin when the base is attached to a jewelers' bench immediately behind the jeweler's bench anvil and jeweler's bench pin.

* * * * *